US011141337B2

(12) United States Patent
Horosko

(10) Patent No.: US 11,141,337 B2
(45) Date of Patent: Oct. 12, 2021

(54) PATIENT ARM SUPPORT AND METHOD FOR SUPPORTING A PATIENT'S ARM

(71) Applicant: 9672656 CANADA INC., Dorval (CA)

(72) Inventor: Florence Diane Horosko, Dorval (CA)

( * ) Notice: Subject to any disclaimer, the term of this patent is extended or adjusted under 35 U.S.C. 154(b) by 0 days.

(21) Appl. No.: 16/880,290

(22) Filed: May 21, 2020

(65) Prior Publication Data

US 2020/0276069 A1 Sep. 3, 2020

Related U.S. Application Data

(62) Division of application No. 16/347,980, filed as application No. PCT/CA2017/051433 on Nov. 29, 2017, now abandoned.

(60) Provisional application No. 62/427,888, filed on Nov. 30, 2016.

(51) Int. Cl.
*A61H 9/00* (2006.01)
*A61G 13/12* (2006.01)

(52) U.S. Cl.
CPC ..... *A61G 13/1235* (2013.01); *A61G 13/124* (2013.01); *A61G 13/1265* (2013.01); *A61H 9/0078* (2013.01); *A61G 2200/327* (2013.01); *A61H 2203/0456* (2013.01); *A61H 2205/06* (2013.01)

(58) Field of Classification Search
CPC ..... A61G 13/1235; A61G 13/124; A61G 2200/327; A61G 7/00; A61G 7/05; A61G 7/07; A61G 7/075; A61G 7/065; A61H 9/0078; A61H 2203/0456; A61H 2205/06; A61F 5/3761; A61F 5/30
See application file for complete search history.

(56) References Cited

U.S. PATENT DOCUMENTS

| | | | | |
|---|---|---|---|---|
| 2,237,252 A | | 4/1941 | Longfellow | |
| 4,210,317 A | | 7/1980 | Spann et al. | |
| 4,241,731 A | | 12/1980 | Pauley | |
| 4,270,235 A | * | 6/1981 | Gutmann | A61G 7/075 5/646 |
| 4,730,801 A | | 3/1988 | Cloward | |
| 5,467,782 A | | 11/1995 | Wiseman | |

(Continued)

FOREIGN PATENT DOCUMENTS

| | | |
|---|---|---|
| GB | 2363076 A | 12/2001 |
| WO | WO 2015/051213 A1 | 4/2015 |
| WO | WO 2015/152786 A1 | 10/2015 |

OTHER PUBLICATIONS

International Application No. PCT/CA2017/051433 International Preliminary Report on Patentability Chapter II dated Feb. 4, 2019.

(Continued)

*Primary Examiner* — Quang D Thanh
(74) *Attorney, Agent, or Firm* — Anglehart et al.

(57) ABSTRACT

A patient arm support, a method for using thereof, for supporting an arm of a patient during an operation when the patient is lying in a supine position on an operating table. The patient arm support has a base, an upper surface opposite to the base shaped to receive and to secure onto the patient arm support at least a portion of the arm; a proximal end; a distal end; a groove, running along at least a portion of a length of the upper surface of the patient arm support, for receiving at least one of at least a portion of the arm and a hand joined to the arm.

9 Claims, 16 Drawing Sheets

(56) References Cited

U.S. PATENT DOCUMENTS

| | | | | |
|---|---|---|---|---|
| D413,982 | S | 9/1999 | Swedberg et al. | |
| 6,065,166 | A | 5/2000 | Sharrock et al. | |
| 6,467,487 | B1 | 10/2002 | Rios | |
| 6,622,727 | B2 | 9/2003 | Perry | |
| D518,894 | S | 4/2006 | Kirn | |
| 7,168,114 | B1 | 1/2007 | Larenas | |
| 7,238,163 | B1 | 7/2007 | Fried et al. | |
| 7,441,293 | B1 | 10/2008 | Singer et al. | |
| D642,280 | S | 7/2011 | Goumas | |
| 8,038,632 | B2 | 10/2011 | Flick et al. | |
| 8,646,457 | B2 | 2/2014 | Maynard et al. | |
| 8,745,790 | B1 | 6/2014 | Wyrozub | |
| D733,897 | S | 7/2015 | Rossouw | |
| 9,125,784 | B2 | 9/2015 | Crisco et al. | |
| 9,307,842 | B2 | 4/2016 | Gibbons | |
| 2003/0014820 | A1* | 1/2003 | Fuhriman | A47C 20/023 5/646 |
| 2003/0145862 | A1* | 8/2003 | Perry | A61G 7/065 128/845 |
| 2006/0123546 | A1 | 6/2006 | Horton et al. | |
| 2009/0000625 | A1 | 1/2009 | Alfery | |
| 2009/0250073 | A1 | 10/2009 | Alfery et al. | |
| 2010/0305431 | A1 | 12/2010 | Crisco et al. | |
| 2011/0015554 | A1* | 1/2011 | Morikawa | A61H 1/0292 601/84 |
| 2012/0110742 | A1* | 5/2012 | Lawler | A61G 13/1225 5/632 |
| 2014/0048081 | A1 | 2/2014 | Squitieri | |
| 2014/0059772 | A1 | 3/2014 | Crisco et al. | |
| 2014/0238408 | A1 | 8/2014 | Shepherd | |
| 2014/0250601 | A1 | 9/2014 | Gomez | |
| 2014/0263878 | A1 | 9/2014 | Moy et al. | |
| 2015/0328393 | A1 | 11/2015 | Stephens et al. | |
| 2015/0335831 | A1 | 11/2015 | De Zayas | |
| 2015/0351707 | A1 | 12/2015 | Sampognaro | |

OTHER PUBLICATIONS

International Application No. PCT/CA2017/051433 International Search Report dated Feb. 23, 2018.

International Application No. PCT/CA2017/051433 Search Strategy dated Feb. 23, 2018.

International Application No. PCT/CA2017/051433 Written Opinion of the International Searching Authority dated Feb. 23, 2018.

* cited by examiner

PATIENT ARM SUPPORT AND METHOD FOR SUPPORTING A PATIENT'S ARM

The present application claims priority of U.S. provisional patent application No. 62/427,888 filed on Nov. 30, 2016.

TECHNICAL FIELD

The present disclosure relates to surgical patient arm supports and methods for supporting a patient's arm during a surgical operation.

BACKGROUND

Perioperative peripheral nerve damage during surgical operations results in a significant source of morbidity and paresthesias for patients and is a common cause of professional liability for anesthesiologists. Nerve damage may be caused by the patient remaining immobile for a significant period during the operation while they are anesthetized.

The nerve that is the most common site of post-operative nerve damage is the ulnar nerve, accounting for over 25% of claims for anesthesia-related nerve injuries in the ASA closed claims database. This nerve runs between the humerus bone and the olecranon process of the ulna bone and is the largest unprotected nerve in the human body. A source of damage to the ulnar nerve during an operation is continuous pressure on the nerve, such as from the weight of the upper arm, while the patient maintains the same position during the procedure. As pressure is continuously applied onto the nerve, this results in the reduction of vascular perfusion, which may lead to irreparable nerve damage. The ulnar nerve is particularly vulnerable to compression injury, especially when the forearm is extended and pronated.

Furthermore, it has been found that damage to the ulnar nerve may, nevertheless, occur despite the presence of padding (such as padding provided by a soft surface covering the operating table), this padding providing cushioning namely at the elbow. Supination of the patient's arms has, also, not been an adequate solution to prevent nerve injury as there still have been reports of damage to the ulnar nerve despite supination.

Aside from the ulnar nerve, damage to other nerves in the arm, such as the brachial plexus, the radial nerve or the median nerve may also result due to similar strain and compression during surgery. For instance, most brachial plexus related nerve injuries are caused by stretching and traction of the plexus. This may result when arm abduction is equal to or greater than 90 degrees. As for the radial nerve, it may be subject to compression injury, as a result of pressure applied by, for example, the underlying bone, or an improperly applied or used medical instrument. As for damage to the median nerve, it may result when the wrist is extended beyond a comfortable range.

In order to remedy possible nerve damage, one solution is to add a soft, flat and slightly elevated brace in which the arm may rest, with the elbow facing down into the soft material of the brace. However, as mentioned herein, studies have shown that damage to the nerves, such as the ulnar nerve, may still result, despite the padding provided by this kind of brace.

Reference will now be made to FIG. 1. FIG. 1 depicts an example of the prior art, wherein the patient's arms rest directly upon an operating table 20, the operating table 20 having a padding material 26 on top of a solid hard surface 25. In this FIG. 1, the patient would be placed in the supine position, with the patient's arms extended perpendicularly away from the body. The operating table 20 has a core portion 24. Joined to the core portion 24 is a lateral portion 22. This lateral portion 22 supports the arms in a designated position, such as when the arms lie perpendicular to the body. The lateral portion 22 may also be described as an armboard. In exemplary operating tables 20, each of the lateral portions 22 (one for each arm) may swivel along the same plane as the core portion 24 from a point at which these lateral portions 22 are joined to the core portion 24, thus allowing the arms to be placed, for instance, nearer the patient's head, at a position perpendicular to the body, or further from the patient's head and closer to the patient's waist, depending on the positioning of the lateral portion 22 with respect to the core portion 24. The surface of the lateral portion 22 is flush with the core portion 24. The patient's shoulder complex rests directly on the padding 26 of the operating table 20. Each of the arms is extended and rests on each of the lateral portions 22, as each of the upper arm 12 extends, naturally downwards from the shoulder to the surface of the operating table 20. This downward position stretches the brachial plexus and puts undesired strain on the nerves of the arm. This stretching may, thus, cause damage to the nerves of the arm, resulting in paresthesia and/or paralysis. Furthermore, as the upper arm 12 is sloped downward towards the elbow, this angle can, also, result in undesired pressure being applied onto the elbow. The elbow rests on the surface of the operating table 20 such that the weight of the whole arm is supported by the elbow resting on the operating table 20. This results in undesired pressure to the unprotected ulnar nerve. Despite the presence of the padding 26, uninterrupted pressure on the ulnar nerve, such as during a surgical operation, could lead to damage to this nerve. This is a result of reduction of blood flow to the nerve.

As the hand 14 is also lying flat on the padding 26, this position of the hand 14 may also result in over-extension of the wrist, due to the angle formed between the hand 14 and the forearm 13. This may unduly stress the median nerve and may result in paresthesia, carpal tunnel and possible nerve damage. There is also a risk of developing edema of the hand.

Furthermore, when preparing the patient for an operation, the anesthesiologist may use blankets to provide warmth, protection and support for the arms. As such, the arms may be wrapped in these blankets. Blankets may also be folded or rolled and placed under the arm in order to lift the arm so it may rest above the operating table 20 on the blankets. However, such padding and protection from the blankets may not be sufficient to avoid nerve damage during an operation.

Moreover, an additional flat support of a defined thickness may be placed under a portion of the arm, laid on the lateral portion 22 of the operating table 20, in order to lift the arm up from the operating table 20 and to provide extra padding. This flat support may be a gel pad. The flat support on its own is not sufficient to eliminate injury to the nerves as it does not correct such underlying problems as, for example, the angle between the upper arm 12 and the forearm 13, as the upper arm 12 is angled downwards from the shoulder.

SUMMARY

When the patient's arm is resting on a patient arm support and when the patient is lying in the supine position, it has been discovered that providing the patient arm support with a gap at the location where the elbow of the patient is positioned may reduce injury to the ulnar nerve during an operation. The gap provides sufficient space for the elbow so that the elbow does not come into contact with the surface of the patient arm support. This absence of contact reduces the possibility that pressure will build up on the portion of the cavity at the elbow where the ulnar nerve is exposed.

Furthermore, it has been discovered that extending the patient arm support so it can support the full length of the patient's arm and at least a portion of the patient's shoulder complex, in some cases well under the scapula, may reduce traction and hypoperfusion of the brachial plexus. Furthermore, for patients prone to dislocation at the level of the shoulder, the shoulder complex portion of the patient arm support may also reduce the risk of shoulder dislocation or strain during the course of the operation.

A broad aspect of the disclosure is a method for supporting a patient's arm and for preventing paraesthesia in the arm by using a patient arm support during an operation when the patient is in a supine position on an operating table. The method includes laying the patient in a supine position on the operating table. The method includes placing the arm of the patient on the patient arm support so that a tapered wedge portion of the patient arm support is wedged between at least a part of a shoulder complex of the patient and the operating table and where the tapered wedge portion elevates the at least a part of the shoulder complex for limiting the stretching of nerves and blood vessels of the brachial plexus. The method includes repositioning the patient arm support so that an elbow of the arm is positioned in an elbow region of the patient arm support for receiving the elbow and for avoiding harmful pressure on an ulnar nerve.

In some embodiments, the method may include supporting with a hand portion of the patient arm support an entire back of a hand joined to the arm.

In some embodiments, the method may include placing fingers of the hand in an upward curved position while the hand is resting on an upward curved portion of the hand portion.

In some embodiments, the method may include anesthetizing the patient.

In some embodiments, the method may include positioning a wrist of the patient in a wrist region of the patient art support for receiving the wrist.

In some embodiments, the method may include massaging the arm by pumping air through air pockets of the patient arm support using an air pump.

Another broad aspect of the disclosure is a patient arm support for supporting an arm of a patient during an operation when the patient is lying in a supine position on an operating table. The support includes a base, for resting the patient arm support on a surface. The support includes an upper surface opposite to the base shaped to receive and to secure onto the patient arm support at least a portion of the arm. The support includes a proximal end, and a distal end opposite to the proximal end. The support includes a thickness, perpendicular to the base, measured from the base to the upper surface. The support includes a groove, running along at least a portion of a length of the upper surface of the patient arm support, for receiving at least one of at least a portion of the arm and a hand joined to the arm. The support includes a tapered wedge portion at the proximal end, the tapered wedge portion having a shoulder complex receiving surface for receiving at least a part of a shoulder complex of the patient, the tapered wedge portion gradually increasing in the thickness as a function of a distance from the proximal end for elevating the at least a part of the shoulder complex above the operating table, for limiting the stretching of nerves and blood vessels of the brachial plexus. The support includes an elbow region for receiving an elbow of the arm to avoid any harmful pressure on an ulnar nerve. The support includes an upper arm portion for receiving an upper arm of the arm, wherein the thickness of the upper arm portion is greater nearer the proximal end than nearer the elbow region. The support includes a forearm portion for receiving a forearm of the arm, wherein the thickness of the forearm portion is lesser nearer the elbow region than nearer the distal end.

In some embodiments, the support may include a hand portion near the distal end for receiving the hand.

In some embodiments, the hand portion may include an upward curved portion for resting fingers of the hand in an upward curved position while the fingers rest on the upward curved portion of the hand portion.

In some embodiments, the thickness of the upper arm portion nearer the proximal end may be similar to the thickness of the hand portion.

In some embodiments, the support may include a wrist region for receiving a patient's wrist.

In some embodiments, the support may include a wrist marking on an outside surface of the patient arm support for indicating a location of the wrist region.

In some embodiments, the wrist region may include a cavity.

In some embodiments, the patient arm support may include a fastener adapted to fasten the patient arm support to the operating table.

In some embodiments, the fastener may include a hook and loop fastening means.

In some embodiments, the fastener may include at least one strap for attaching the patient arm support to the operating table.

In some embodiments, the support may include an air pump and air pockets for massaging the patient's arm, wherein air is directed to the air pockets by the air pump.

In some embodiments, the support may include an elbow marking on an outside surface of the patient arm support for indicating a location of the elbow region.

In some embodiments, the elbow region may include a cavity.

In some embodiments, the patient arm support may include two walls, wherein a first wall of the two walls may be of a first length and may run at least part of a length of the groove on a first side of the groove, and a second wall of the two walls may be of a second length and may run at least a part of the length of the groove on a second side of the groove, wherein the first length of the first wall may be less than the second length of the second wall.

Another broad aspect of the disclosure is a method for supporting a patient's arm during an operation when the patient is lying in a supine position on an operating table and for preventing paraesthesia in the arm by using a patient arm support having a proximal tapered wedge portion comprising supporting at least a part of a shoulder complex of the patient to elevate the at least a part of the shoulder complex with respect to the operating table for limiting the stretching of nerves and blood vessels of the brachial plexus to avoid paraesthesia in the arm.

BRIEF DESCRIPTION OF DRAWINGS

The invention will be better understood by way of the following detailed description of embodiments of the invention with reference to the appended drawings, in which.

DETAILED DESCRIPTION

In the present detailed description, the word "arm" is defined as the entire arm, from the shoulder joint to the wrist, this including the upper arm and the forearm.

The expression "shoulder complex" is defined as the acromioclavicular, sternoclavicular, glenohumeral and scapulothoracic joints, and their associated muscles and bones attached to the scapula.

The patient arm support described herein and methods for using same relate to providing support to at least one arm during a surgical operation while minimizing undue pressure on the nerves and loss of blood flow in the arm.

Figure 2:
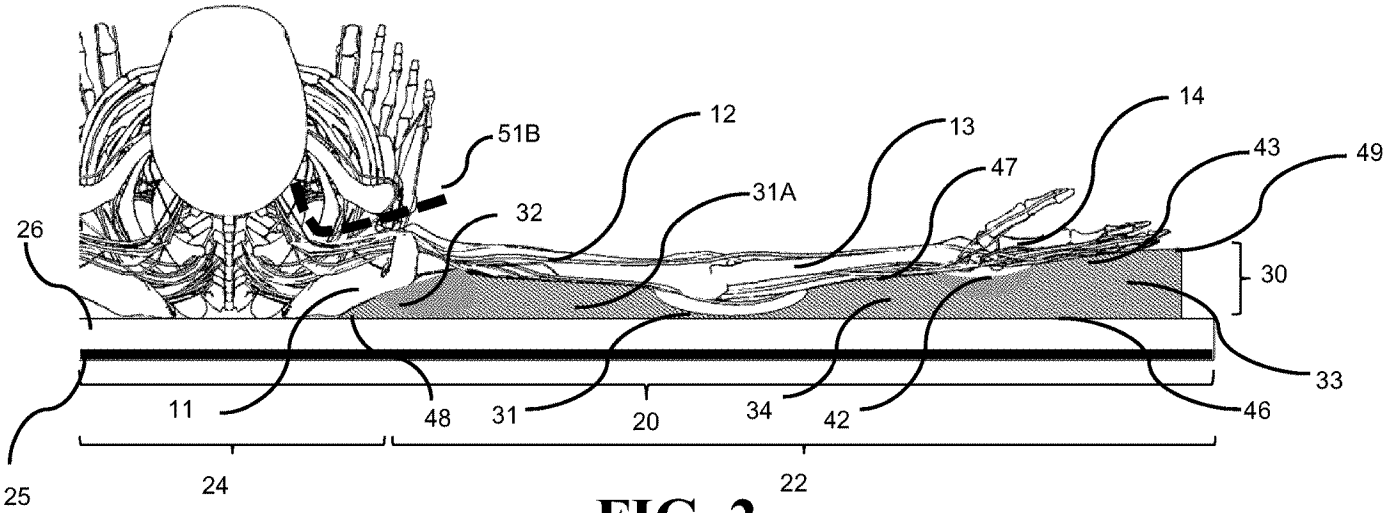
FIG. 2 is a cross-sectional view of an exemplary patient arm support, when a patient is lying in a supine position on an operating table and the patient's arm is resting on the patient arm support.
Figure 3:
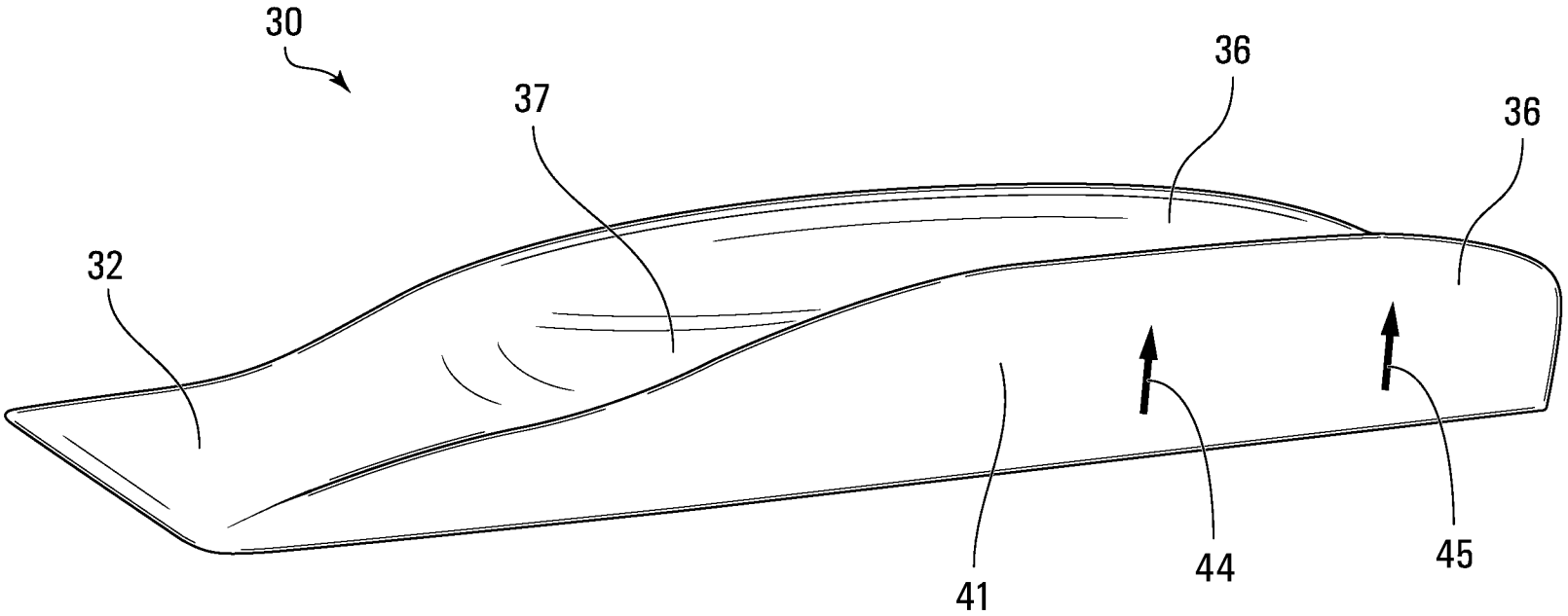
FIG. 3 is a lateral view of an exemplary patient arm support.

FIGS. 2 and 3 illustrate an exemplary patient arm support 30. The patient arm support 30 is shaped to receive the arm of a patient lying in a supine position during, for instance, an operation. In the supine position, the patient's arm may be resting on a patient arm support 30 on top of a lateral portion 22 of an operating table 20 (i.e. armboards) forming an angle of 90 degrees or less with the core portion of the operating table 20. The lateral portion 22 may be parallel with the floor. The lateral portion 22 may be level with the core portion 24 of the operating table 20. The core portion 24 of the operating table 20 may be defined as the portion of the operating table 20 receiving at least the trunk of the patient.

Even though the patient arm support 30 may be used during a surgical procedure, the patient arm support 30 can also be used for any procedure or time when a person is to lie on his or her back for a prolonged period with limited to no movement. Such instances may be, for instance, during convalescence or when a patient is confined to bed for a prolonged time.

In the case of a surgical operation during which the patient is anesthetized, the patient remains immobile which may result in growing pressure points at different locations on the patient's body. Such pressure points can lead to nerve damage. Therefore, the patient arm support 30 may be used to position the arm in a relaxed position while reducing pressure exerted on portions of the arm which may namely lead to nerve damage.

During an operation, one patient arm support 30 may be used, or alternatively, two patient arm supports 30 may be used, where each of the patient arm supports 30 is used to support one of the patient's arms.

The patient arm support 30 has a base 46 for resting on a surface such as an operating table 20. On the opposite side of the base, the patient arm support 30 has a resting surface 47 on which the patient's arm is placed and may rest. The patient arm support 30 also has a proximal end 48 and a distal end 49 opposite to the proximal end 48.

The patient arm support 30 has a tapered portion 32 at the proximal end 48, a set of walls 36 and a groove 37. The patient arm support 30 also has an upper arm portion 31A, a forearm portion 34 and an elbow gap 31 shaped to receive an elbow, the elbow gap 31 located between the upper arm portion 31A and the forearm portion 34. The patient arm support 30 may also have a wrist region 42 and a hand portion 33 near the distal end 49. The hand portion 33 may also have an upward curved portion 43.

As shown in FIG. 3, the patient arm support 30 has a groove 37 for receiving at least a portion of the patient's arm. The groove is a space on the top surface of the patient arm support 30, on which the patient's arm is to be placed. The groove 37 may extend across the upper arm portion 31A, the forearm portion 34 and optionally, the hand portion 33. The groove 37 is shaped to receive the patient's arm.

The patient arm support 30 has a tapered portion 32 which rests under at least a part of the patient's shoulder complex 11. This tapered portion 32 is wedged between the shoulder complex 11 and the operating table 20. The tapered portion 32 may be wedge shaped, where the thinnest portion is placed between the patient's shoulder complex 11 and the surface on which the patient is resting (e.g. the operating table 20). The weight of at least a part of the shoulder complex 11 on the tapered portion 32 may provide anchoring of the patient arm support 30 to the operating table 20, as the weight of the body of the patient may hold the tapered portion 32 and the patient arm support 30 in place. The slope of the tapered portion 32 may be of a gentle upward incline in order to slightly elevate the patient's arm and reduce strain on the brachial plexus and the shoulder joint, including the muscles, tendons and nerves located in proximity to the shoulder joint, this incline illustrated for example by curve 51B (following the slope of the shoulder and shoulder complex 11) when compared with the flatter incline representing that of the shoulder and shoulder complex, as shown by curve 51A in the prior art FIG. 1A. This reduction in strain may also provide support to patients who are predisposed to shoulder dislocation, by reducing the strain applied to the shoulder when lying in a supine position. Furthermore, the upper surface of the tapered portion 32 on which rests the shoulder complex 11 may be slightly curved to cup and mold to the shoulder complex 11 and upper portion of the patient's back. In some embodiments, the tapered portion 32 may be shaped to fully extend across the full length of the shoulder complex 11. In other embodiments, the tapered portion 32 may be shaped to extend across only a portion of length of the patient's shoulder complex 11.

Figure 1:
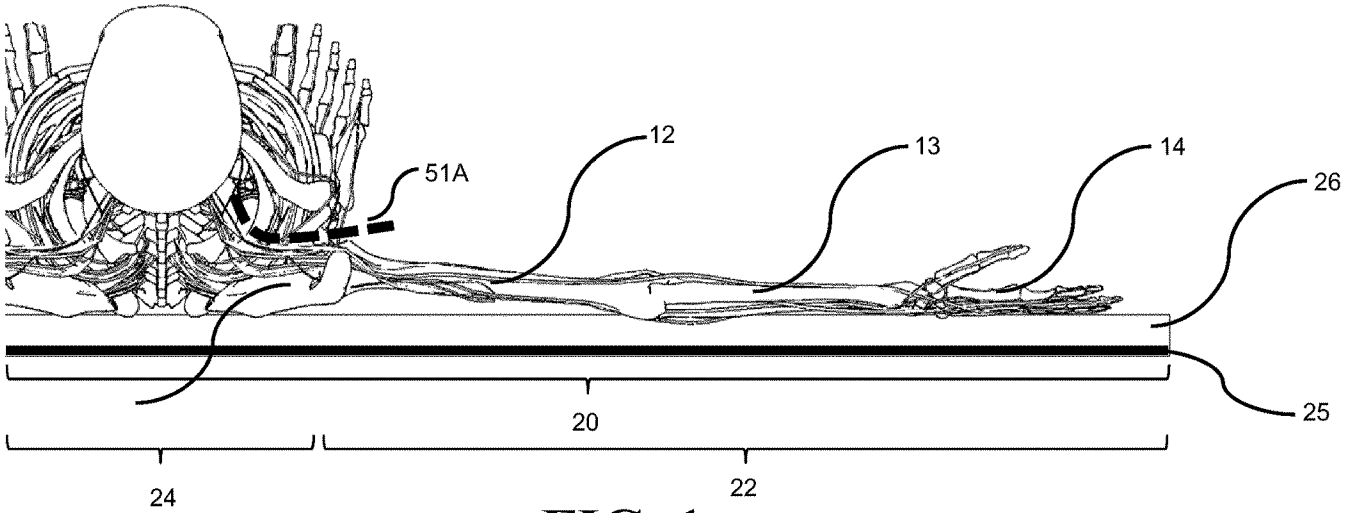
FIG. 1 Prior Art
FIG. 1 is a cross-sectional view of a portion of the upper half of a patient lying in a supine position on an operating table according to the prior art when the patient is lying in a supine position.

The tapered portion 32 may also slightly lift the shoulder complex 11 above the operating table 20, where the tapered portion 32 rises slightly the shoulder complex 11 from the operating table 20. This rising of the shoulder complex 11 and the support provided by the patient arm support 30 to the upper arm 12 in turn may also result in reducing the downward angle of the upper arm 12. In FIG. 1A, the upper arm 12 naturally slopes downward as a result of the upper arm 12 and the shoulder complex 11 lying directly on the flat operating table 20. This positioning adds strain on the brachial plexus and the portion around the shoulder joint, such as the rotator cuff. Furthermore, the inclined position of the upper arm 12 may also add additional weight on the elbow, such as the weight of the arm on the elbow, which may result in applying undesired pressure on the ulnar nerve, increasing the risk of damage to this nerve as a result of compression. As shown in FIG. 2, by elevating the shoulder complex 11 slightly above the operating table 20 and by maintaining or only slightly reducing this elevation for the rest of the arm supported by the patient arm support 30, the upper arm 12 may also gently slope downward. However, the weight of the arm is supported and may be distributed along the upper arm portion 31A. This position may also reduce strain in the area around the shoulder joint. Second, as the upper arm's 12 downward slope is minimized, this position of the upper arm 12 may diminish the pressure caused by the arm to the elbow and the ulnar nerve, the weight of the upper arm 12 distributed along the padding of the upper arm portion 31A instead of focused towards the elbow region. This may limit the risk of injury to the ulnar nerve as a result of compression.

Alternatively, and aside or in addition to the tapered portion 32 anchoring the patient arm support 30 in place, the patient arm support 30 may be held in place using a fastening means, such as a hook and loop fastener 57 like Velcro®, wherein a strip of the fastening means lies across the operating table 20, spanning from one lateral portion 22 to the other or at least across certain portions of each of the lateral portions 22, and where the complementary strip is found at the base of the arm patient support 30 for adhering to the strip found on the operating table. The fastening means would allow each patient arm support 30 to be placed at a designated location on the operating table 20, for limiting movement during the operation procedure, where the fastening means found on the patient arm support 30 may be joined at the desired location to the complementary portion of the fastening means running across the operating table where the patient's arms are to lie. For instance, the hook portion of the hook and loop fastening means may be joined to the base of the patient arm support 30 and the corresponding loop portion of the hook and loop fastening means may be joined to the lateral portion 22 of the operating table 20. Once the patient arm support 30 is properly positioned at a desired location to receive the patient's arm, then the hook portion and loop portion may be joined, holding the patient arm support 30 in place during the operation. In the case where two patient arm supports 30 are used (one for each arm), this would allow, for instance, for adjustment of the distance between each of the patient arm supports 30 in accordance with the proportions of the patient, such as the distance between each of the patient's shoulder complex 11. A skilled person will readily recognize that other forms of fastening may be used, such as an elastic strap or an adjustable strap 56 attached to the patient arm support 30 that may wrap around the lateral portion 22 of the operating table 20 and hold the patient arm support 30 in place, without departing from the present teachings. In other embodiments, the fastening means may be a series of snaps, where, for instance, a male part of the snap fastener is located on the base of the pillow and the female part of the snap fastener is located on, for example, the lateral portion 22 of the operating table 20. In another embodiment, the fastening means may be a sleeve, to which the patient arm support 30 is attached, where the sleeve is shaped to hug the contours of at least a portion of the lateral portion 22 of the operating table 20, the lateral portion 22 of the operating table 20 inserted into the sleeve. The sleeve may be of a stretchable or elastic material to provide a snug fit around the lateral portion 22.

The patient arm support 30 may also have an upper arm portion 31A. The upper arm portion 31A receives the upper arm 12 of the patient. In some embodiments, the upper arm portion 31A may be parallel with the operating table 20. In other embodiments, the upper arm portion 31A may have a slight incline downward. In the embodiment of the patient arm support 30 where the upper arm portion 31A has a slight downward incline, when the patient's arm is resting in this exemplary embodiment of the patient arm support 30, the portion of the upper arm 12 nearer to the shoulder is slightly more elevated from the base 46 than the portion of the upper arm 12 located nearer to the elbow.

In some embodiments, when a patient's arm and hand 14 is resting on an exemplary patient arm support 30, the patient's shoulder and the portion of the patient's upper arm 12 nearest to the shoulder may be approximately at the same height from the base 46 as the patient's hand 14. The hand portion 33, the portion of the forearm portion 34 nearer to the hand portion 33, and the portion of the upper arm portion 31A nearer the proximal end 48, may be near the same height so as to maintain blood flow in the hand 14 and the fingers of the hand 14 while the patient's arm and hand 14 are resting on a patient arm support 30.

The patient arm support 30 has an elbow region 31 in the groove 37 for receiving the elbow of the patient's arm. The elbow region 31 may be a cavity and is shaped with a sufficient depth and width so as to accommodate the patient's elbow and minimize contact of the surface of the patient arm support 30 on the elbow which may lead to undesirable pressure during, for example, the course of a surgical operation. In some embodiments, the elbow region 31 is of such dimensions so that there is no contact between the elbow and the patient arm support 30 when the patient's arm is resting on the patient arm support 30. In some embodiments, the elbow region 31 may be of a half-moon shape, forming a half-moon indentation in the groove 37 of patient arm support 30. In other embodiments, the elbow region 31 may be, for example, of a rectangular prism shape. It may be appreciated that the elbow region 31 may be of any shape that creates sufficient spacing between the patient's elbow and the surface of the patient arm support 30, so as to limit and/or eliminate contact between the patient arm support 30 and the elbow. In some embodiments, the elbow region 31 may be filled with a very soft foam, where little to no pressure is applied by the foam to the elbow.

Furthermore, the elbow region 31 may separate the upper arm portion 31A from the forearm portion 34.

The patient arm support 30 may have an elbow marking 44 located on the outside surface 41 of the patient arm support 30. This elbow marking 44 may be in the form of an arrow, or a straight line, indicating to, for example, an orderly or nurse the location at which the patient's elbow is to be placed in the patient arm support 30. The elbow marking 44 is aligned with the elbow region 31. The elbow marking 44 may facilitate the positioning of the arm when preparing for a surgical operation, by assisting the surgical staff with the positioning of the patient arm support 30 so that the elbow is aligned with the elbow region 31, for protecting the ulnar nerve. Furthermore, for instance, in an embodiment of the patient arm support 30 where the walls 36 of the patient arm support 30 are opaque, and where the elbow region 31 may not be easily visible when adjusting the patient's arm in the patient arm support 30, the elbow marking 44 may allow for facilitating the alignment of the elbow with the elbow region 31 made to receive the elbow of the patient.

The patient arm support 30 has a forearm portion 34. The forearm portion 34 is shaped to receive the forearm 13 of the patient. The forearm portion 34 may have a slight upward incline, as such that when the patient's arm is resting in the patient arm support 30, the portion of the patient's forearm 13 located nearer to the elbow is lower with respect to the base 46 than the portion of the patient's forearm 13 located nearer to the wrist. A person skilled in the art will readily recognize that the angle of this incline may vary without departing from the present teachings.

The patient arm support 30 also has a hand portion 33 for receiving the entire hand 14 of the patient. This hand portion 33 may also be inclined, where, in some embodiments, the incline of the hand portion 33 may be the same as that of the forearm portion 34. In other embodiments, the incline of the hand portion 33 may be greater or lesser than that of the forearm portion 34. The slight upward inclined of the hand portion 33 may reduce a strain applied to patient's wrist and to the median nerve which would have otherwise resulted from the over extension of the wrist. When the patient is resting on the patient arm support 30, the patient's arm and hand may be placed in the supination position or the neutral position.

Optionally, the hand portion 33 may be shaped in such a way as to allow the fingers of a patient, when the fingers are resting on the hand portion 33, to remain curved slightly upwards while resting on an upward curved portion 43 of the hand portion 33. The upward curved portion 43 may be placed at the furthest region of the hand portion 33 with respect to the tapered portion 32 and has a slight upward curve.

Optionally, there may be a wrist region 42 for receiving the wrist of the patient, extending from the patient's arm. The wrist region 42 may be of a soft foam material for minimizing pressure to the wrist or may be an empty cavity. The wrist region 42 may be located between the forearm portion 34 and the upper hand portion 33. The wrist region 42 is shaped with a sufficient depth and width so as to accommodate the patient's wrist and minimize over extension of the wrist, which may prevent, for instance, compression of the median nerve. In some embodiments, the wrist region 42 may be of a half-moon shape, creating a half-moon indentation in the patient arm support 30. In other embodiments, the wrist region 42 may be a shallow concavity in the surface of the groove 37. However, it will be appreciated that the wrist region 42 may be of any shape that creates sufficient spacing between the patient's wrist and the surface of the patient arm support 30, so as to limit and/or eliminate contact between the patient arm support 30 and the wrist.

The patient arm support 30 may have a wrist marking 45 located on the outside surface 41 of the patient arm support 30. The wrist marking 45 may be in the form of an arrow, or a straight line, for indicating to, for example, an orderly or nurse the location at which the patient's wrist is to be placed in the patient arm support 30. The wrist marking 45 is aligned with the wrist region 42. The wrist marking 45 may facilitate the positioning of the patient arm support 30 when preparing for a surgical operation for aligning the wrist region 42 with the wrist. Furthermore, in some embodiments of the patient arm support 30 where the walls 36 of the patient arm support 30 are opaque, and where the wrist region 42 may not be easily visible when adjusting the patient's arm in the patient arm support 30, the wrist marking 45 allows for facilitating the alignment of the wrist region 42 made to receive the wrist of the patient with the wrist.

As shown in FIG. 3, the patient arm support 30 may have two walls 36, one on each side of the patient arm support 30. Each of the walls 36 is also located on either side of the groove 37. The walls 36 secure the patient's arm when resting in the patient arm support 30. The walls 36 may also prevent the patient's arm from falling off of the operating table 20 when the patient's surgical position is changed during the course of an operation by securing the arm within the patient arm support 30. The inside portion of each of the walls 36 forms a curved surface with the groove 37 for receiving the patient's arm. The groove 37 may also prevent the patient's arm from falling from the patient arm support 30.

In some embodiments, the patient arm support does not have a groove 37 or walls 36. Instead, the patient's arm may be secured to the patient arm support using a strap passing around the patient's arm. This strap may also prevent the patient's arm from falling during the course of the operation.

In some embodiments, as shown in FIG. 9A to 9F, the patient arm support 30 may have at least one wall 36B that spans only part of the length of the patient arm support 30. The partial wall 36B may allow for the patient's arm to be easily placed in the patient arm support 30. Wall 36A and wall 36B assist with securing the arm in the groove of the patient arm support 30. Partial wall 30B may be found on the side of the patient arm support 30 that will be facing the feet of the patient when the patient is placed in a supine position on an operating table, and the patient's arm is positioned in the patient arm support 30. The wall 36A may span a greater length of the patient arm support 30. In some embodiments, wall 36A may span the full length of the patient arm support 30. It will be understood that in the embodiments of the patient arm support 30 that include a wall 36A and a wall 36B, the patient arm support 30 may be adapted for a right arm or for a left arm such that the wall 36B is positioned on the patient arm support 30 such that wall 36B is facing the feet of the patient when the patient's arm is placed in the patient arm support 30 and the patient is in a supine position on an operating table.

In one embodiment, the patient arm support 30 may be dimensioned in such a way so as to accommodate the arm of a large male patient. The dimensions in one example may b as follows: the length of the patient arm support 30 may be 32 inches for accommodating the arm of a large male, and the width of the patient arm support 30, measured from the outside portions of the walls 36, may be 6.75 inches. The height of the patient arm support 30 at the distal end 49, measured perpendicularly from the base 46, may be of 3.9 inches. The dimensions of the patient arm support 30 may be configurable in order to adjust to the arm length and proportions of the patient. In some examples, the different patient arm supports 30 may be available in different standard sizes for accommodating different sized patients (e.g. a size for children, a size for average size adults and a size for tall adults). In an alternative embodiment, each of these standard models of the patient arm support 30 may be provided with an adjustable feature, where the patient arm support 30 may be slightly stretched or adjusted in order to match the proportions of the patient's arm.

Figure 4:
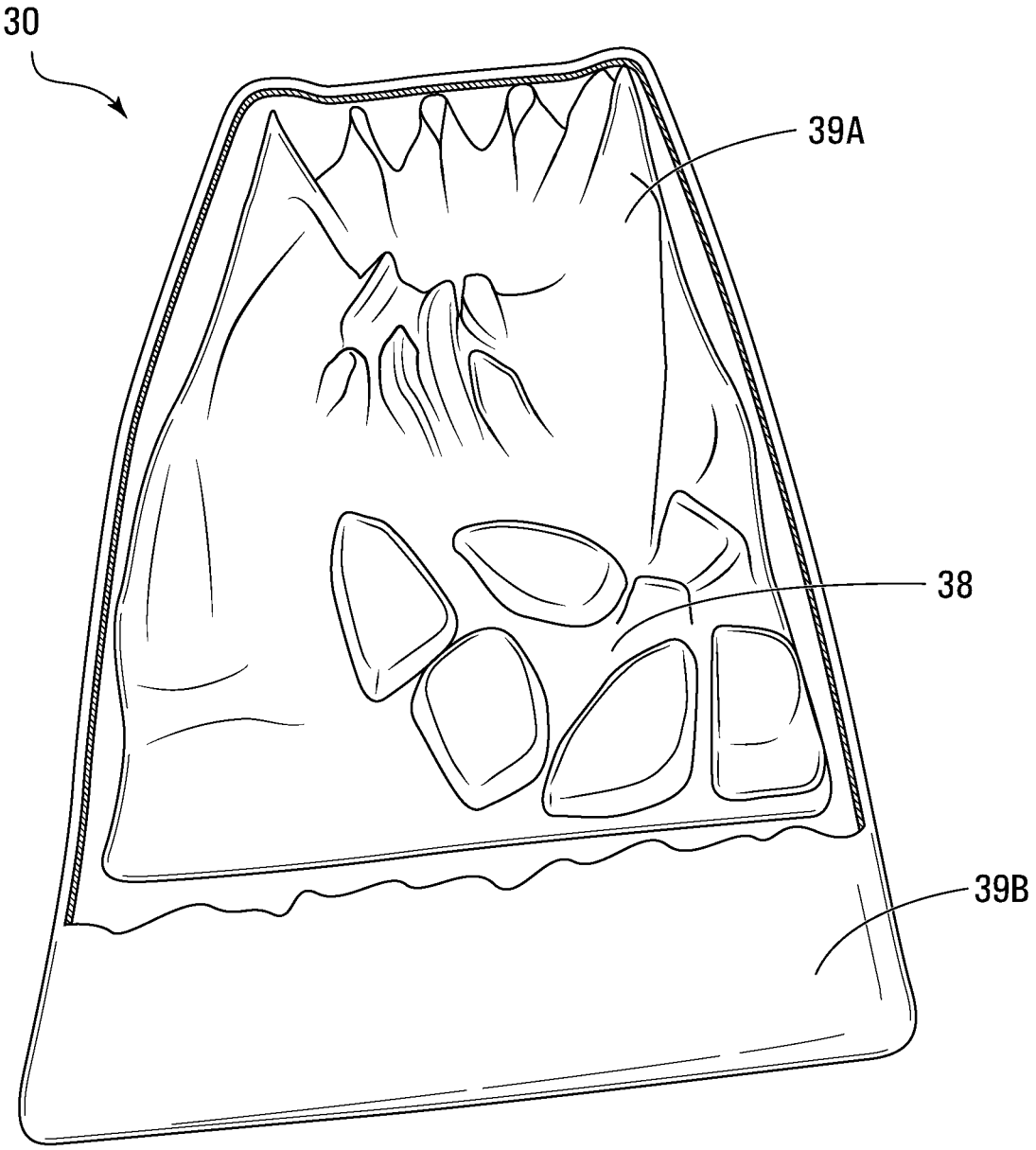
FIG. 4 is a front top-down of the overlaying layer and the mold layer of an exemplary patient arm support.

In an alternative embodiment, as shown in FIG. 4, an exemplary patient arm support 30 may comprise air pockets 38 for massaging the patient's arm as an air pump circulates air through these pockets. This massaging may also remove, reduce or redirect pressure exerted on the arm and its nerves resulting from contact between the arm and the patient arm support 30, and may promote circulation in the arm. In an exemplary embodiment, the patient arm support 30 may be composed of two layers. A first, underlying mold-layer 39A may be shaped to define the different air pockets ranging across the patient arm support 30 for massaging. A second, overlaying layer 39B, placed on top of the mold layer 39A, making contact with the mold layer 39A and which may result in a partial seal between the two layers 39A and 39B, where the pockets 38 in which air may be pumped and circulated are sealed, creating passageways for the air. As pressure increases in the pockets 38 as a result of the air pump, the air exerts a force upon the overlaying layer 39B, this force causing the layer 39B to stretch and release, this change in the layer 39B massaging the patient's arm. In another embodiment, the patient arm support 30 may be composed of a single material, the pockets 38 present within the patient arm support 30. Furthermore, in alternative embodiments, massaging may be provided instead by a motor mechanism, the motor creating for instance slight undulations or vibrations in the material on which the patient's arm is resting.

The outer surface of the patient arm support 30 may be composed of a soft, flexible material for cushioning the patient's arm. In some embodiments, the patient arm support 30 may be made of inert, latex-free and/or fireproof materials. The patient arm support 30 may be composed of hypoallergenic material in order to reduce the probability of an allergic reaction resulting from, for instance, the patient's skin reacting to the material. In some embodiments, the patient arm support may be made out of a soft two-component platinum silicone casting foam, such as the foam Soma Foama® of Smooth-On Inc.

Figure 5A:
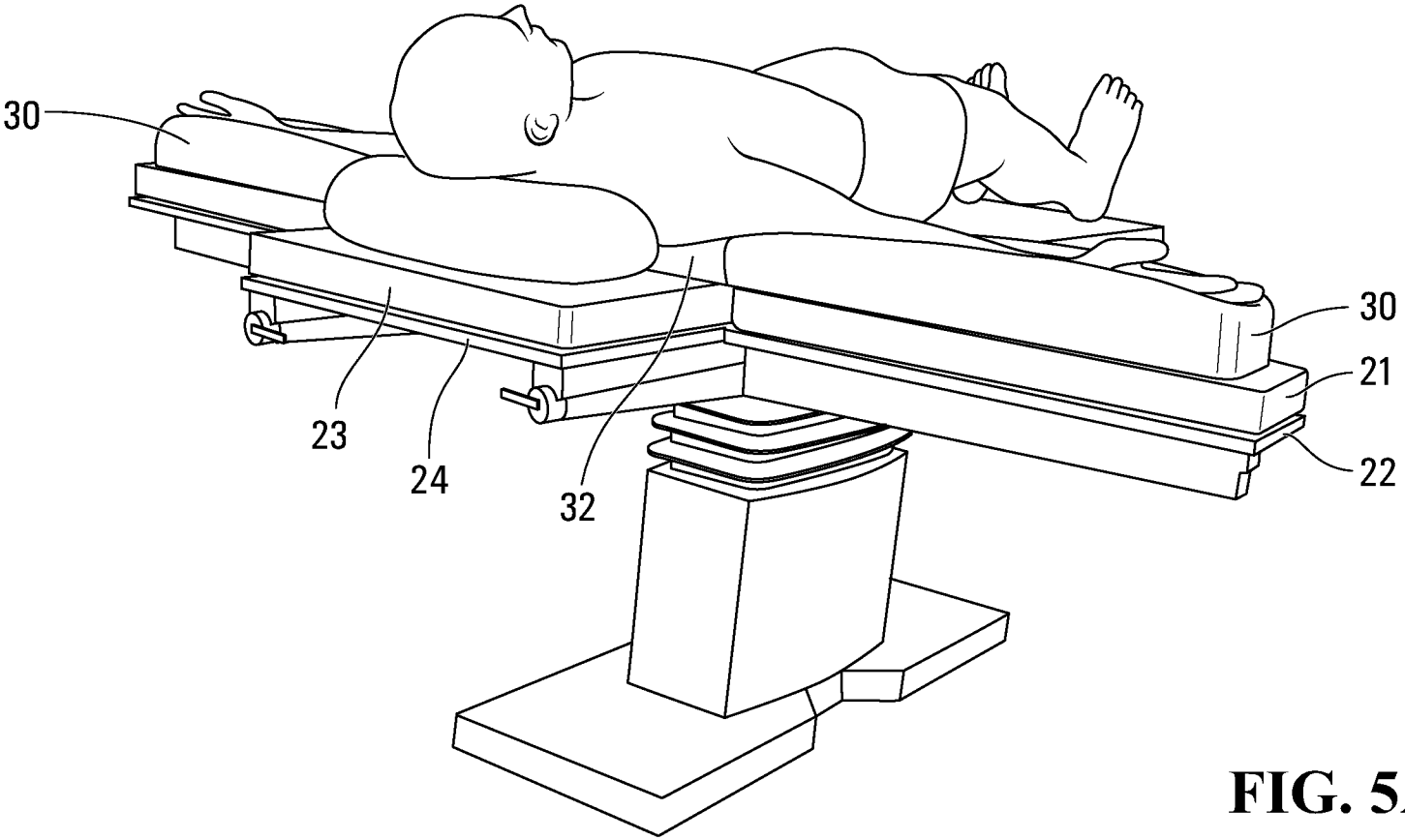
FIG. 5A is a lateral view of a patient lying in a supine position on an operating table with each of the patient's arms resting respectively in exemplary patient arm supports.

FIG. 5A shows a model of a patient lying on the operating table 20, where both of the patient's arms are resting in their own respective exemplary patient arm supports 30. For each of the patient arm supports 30, the entire length of the arms as well as the entire hand is received by the patient arm support 30. The tapered portion 32 is positioned under the patient's shoulder complex and may be anchored in place by the weight of the patient applied onto the tapered portion 32 of the patient arm support 30. As shown in FIG. 5A, a length of the tapered wedge portion 32 is orthogonal with the length of the patient's body when lying on the operating table 20.

Figure 5B:
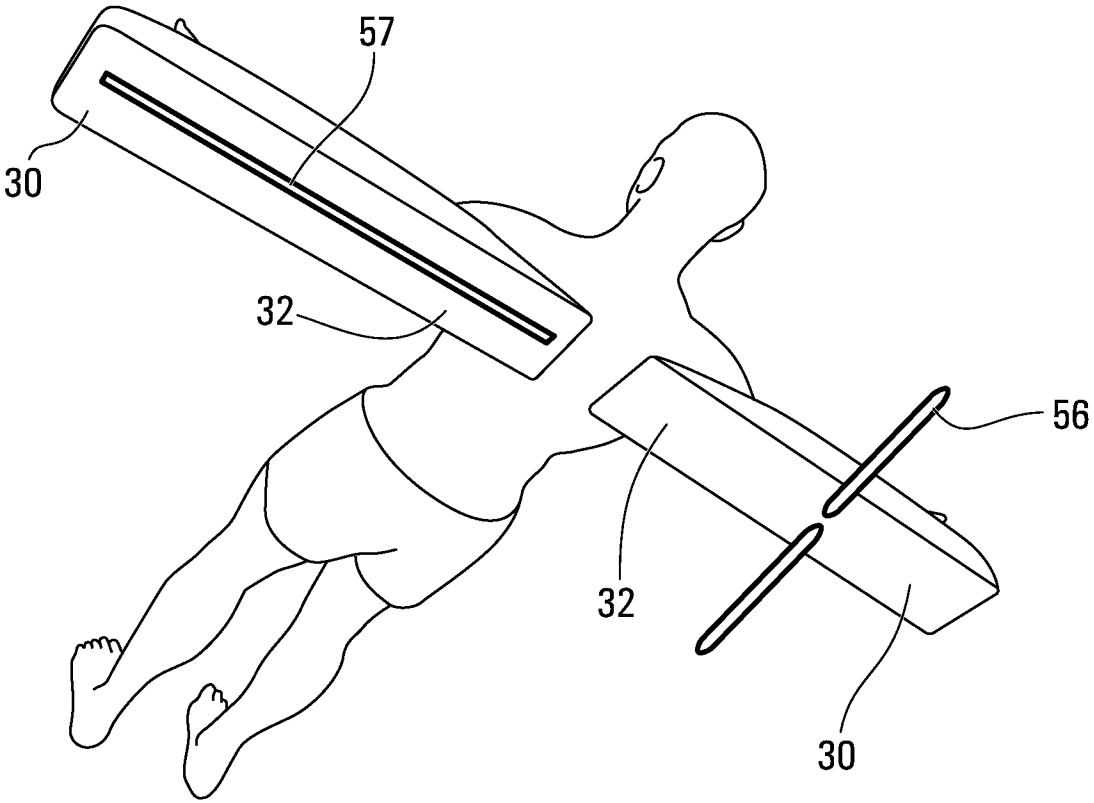
FIG. 5B is a bottom-up view of a patient lying in a supine position with each of patient's arms resting respectively in exemplary patient arm supports.

As shown in FIG. 5B, the tapered portion 32 may extend fully across the patient's shoulder complex, providing anchorage of the patient arm support 30 to the operating table by the patient's upper body, and provide a gentle steady incline away from the proximal end 48, where the patient's shoulder complex and elbow are slightly lifted, resulting in less pressure on the brachial plexus and the shoulder joint.

Figure 6:
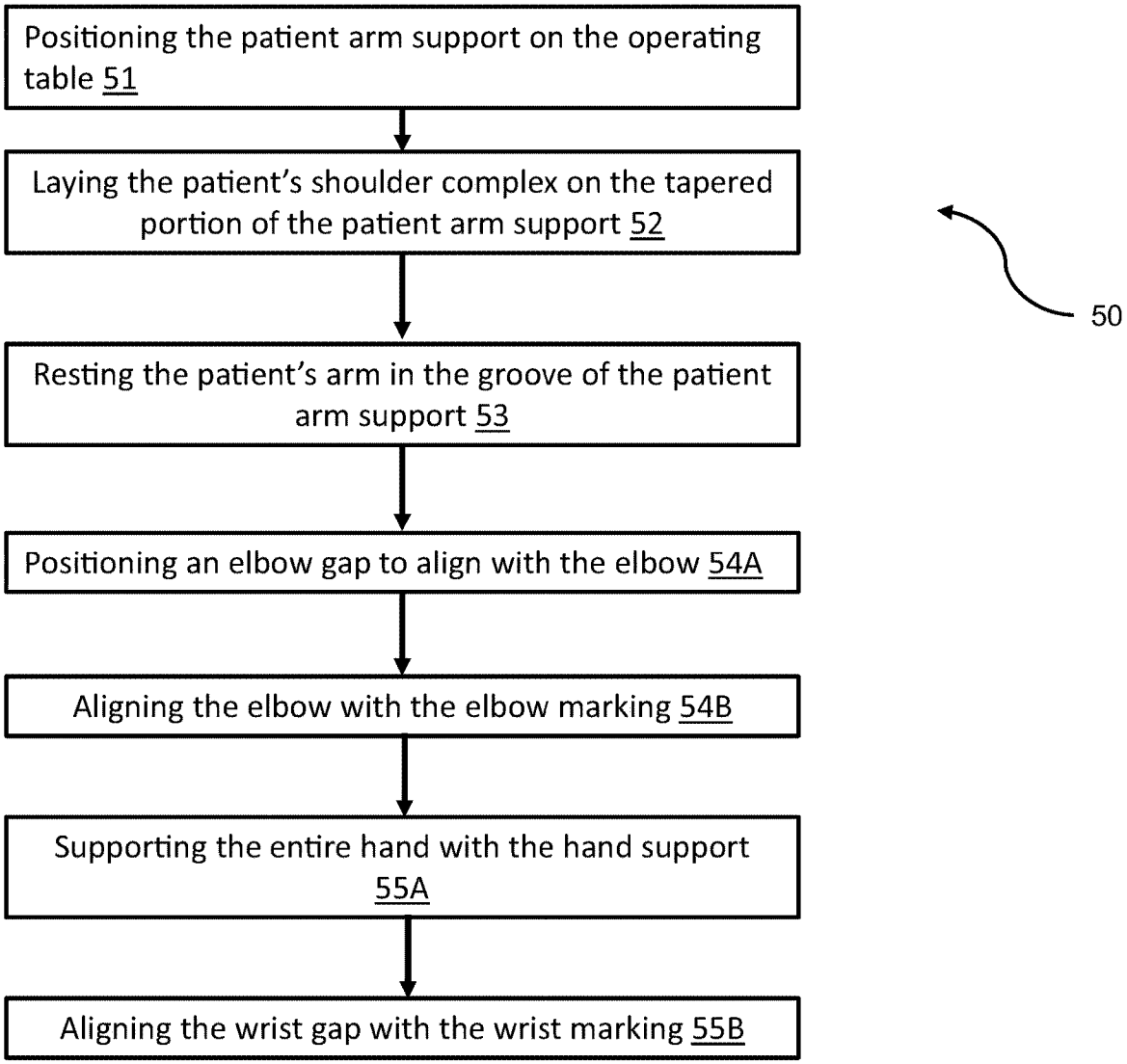
FIG. 6 is a flowchart diagram of an exemplary set of steps for positioning a patient on an operating table with an exemplary patient arm support.
Figure 7A:
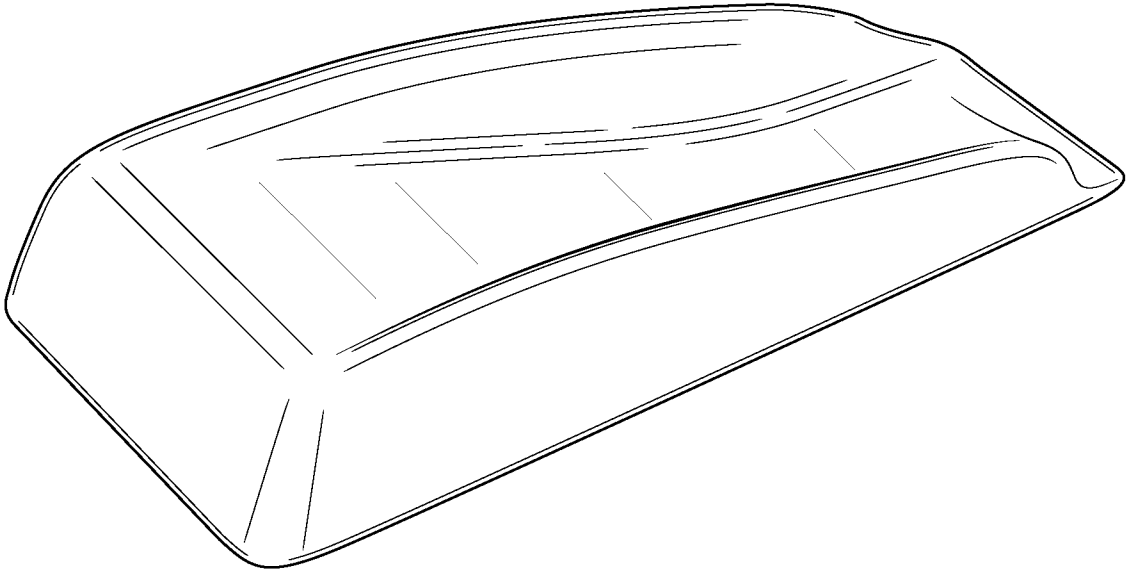
FIG. 7A is a lateral top-down view of an exemplary patient arm support.
Figure 7B:
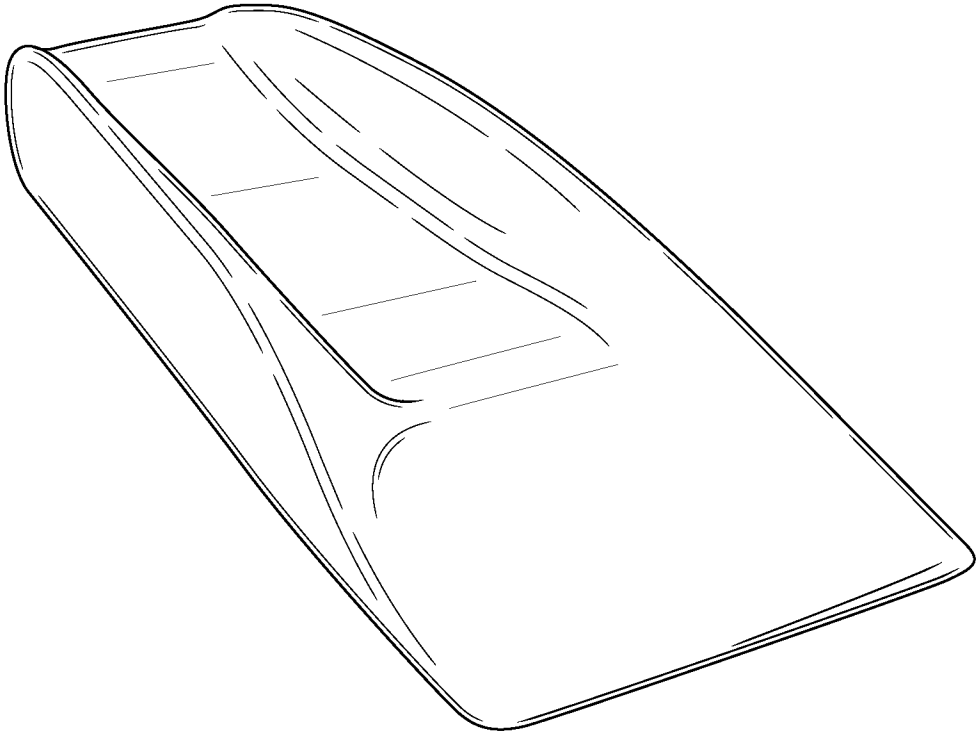
FIG. 7B is a front-lateral top-down view of an exemplary patient arm support.
Figure 7C:
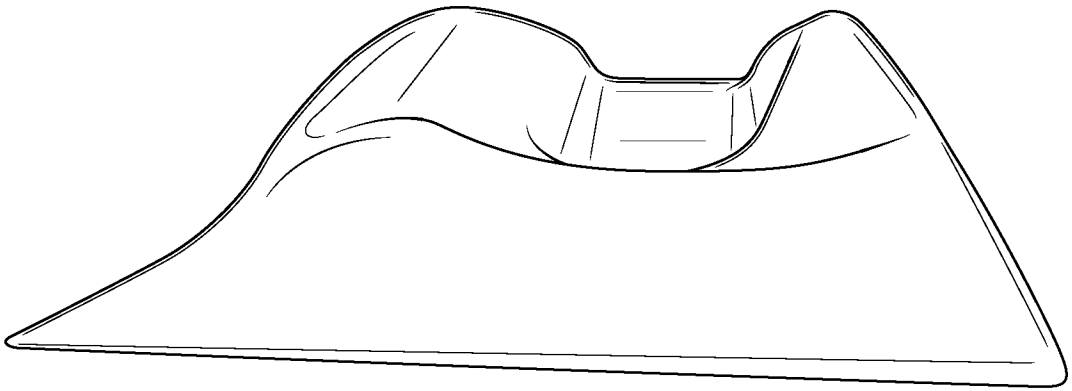
FIG. 7C is a front view of an exemplary patient arm support.
Figure 7D:
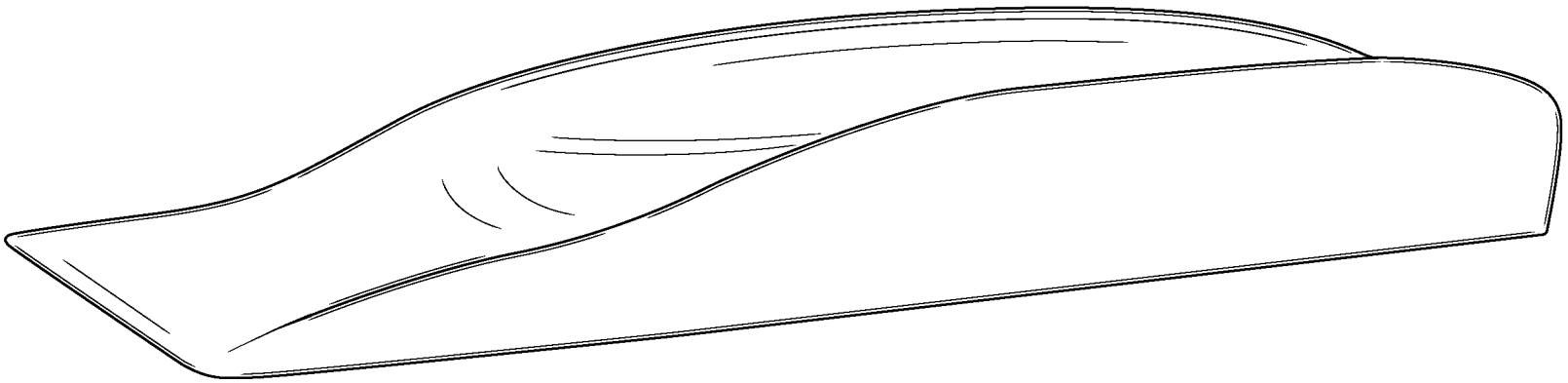
FIG. 7D is a lateral view of an exemplary patient arm support.
Figure 8A:
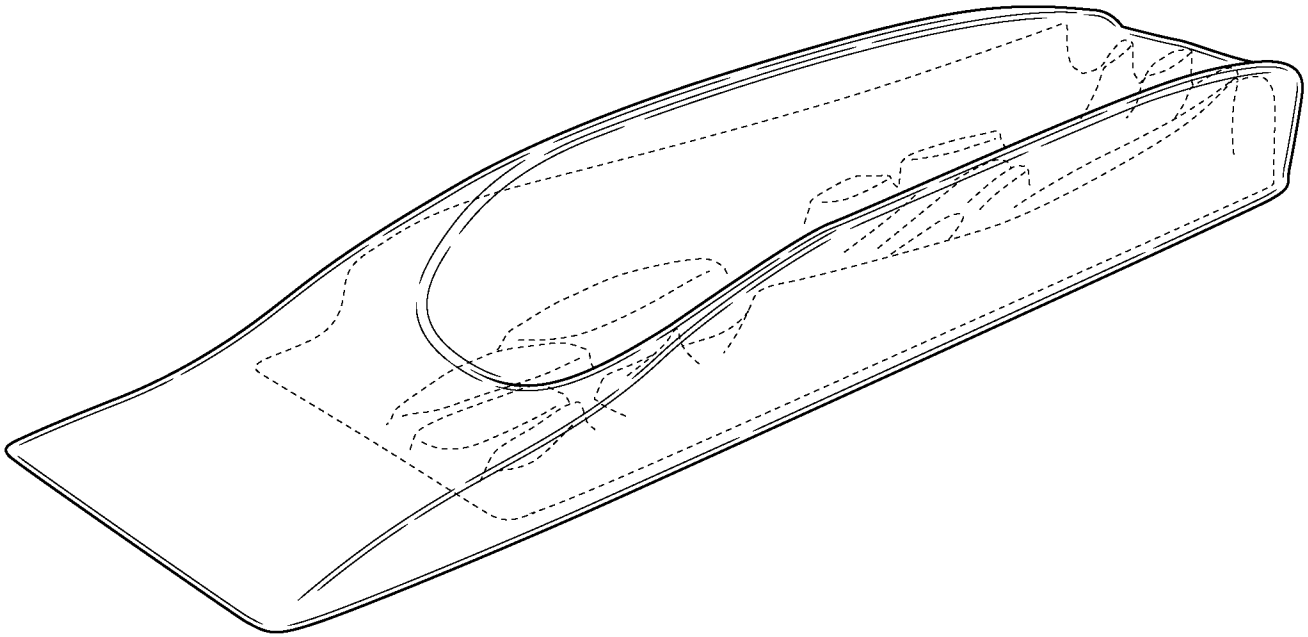
FIG. 8A is a lateral top-down view of the overlaying layer and the mold layer of an exemplary patient arm support.
Figure 8B:
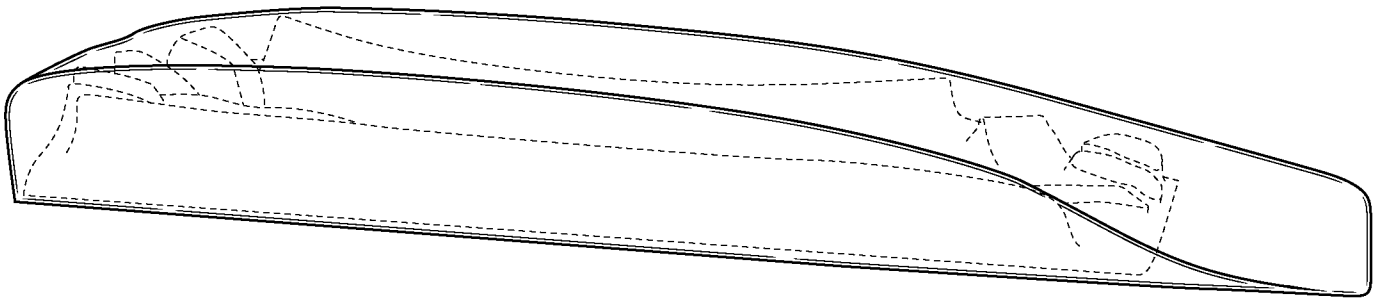
FIG. 8B is a side view of the overlaying layer and the mold layer of an exemplary patient arm support.
Figure 8C:
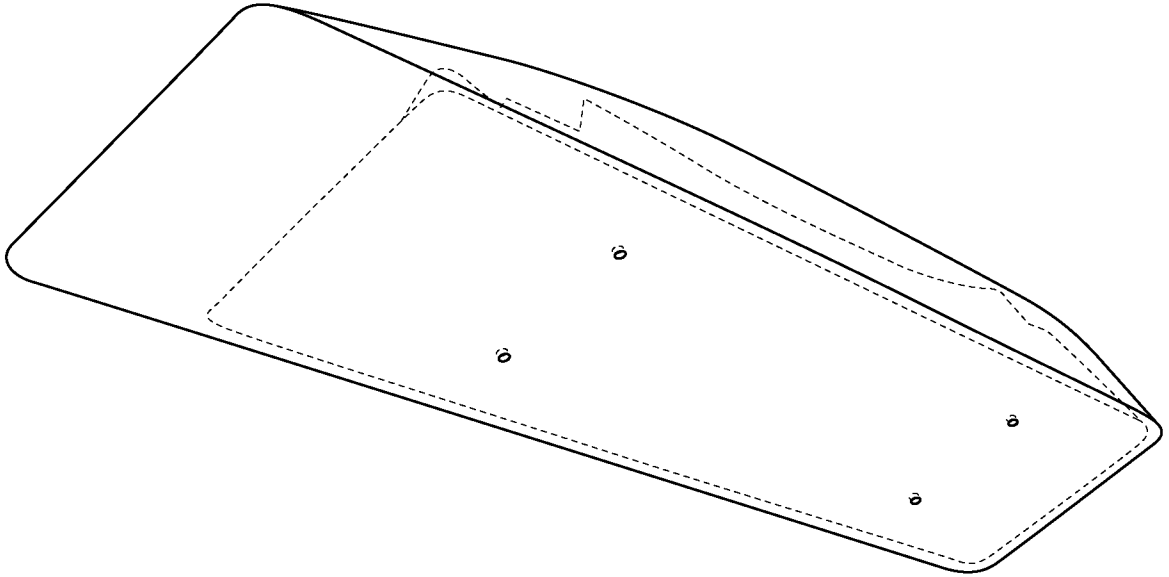
FIG. 8C is a bottom-up view of the overlaying layer and the mold layer of an exemplary patient arm support.
Figure 8D:
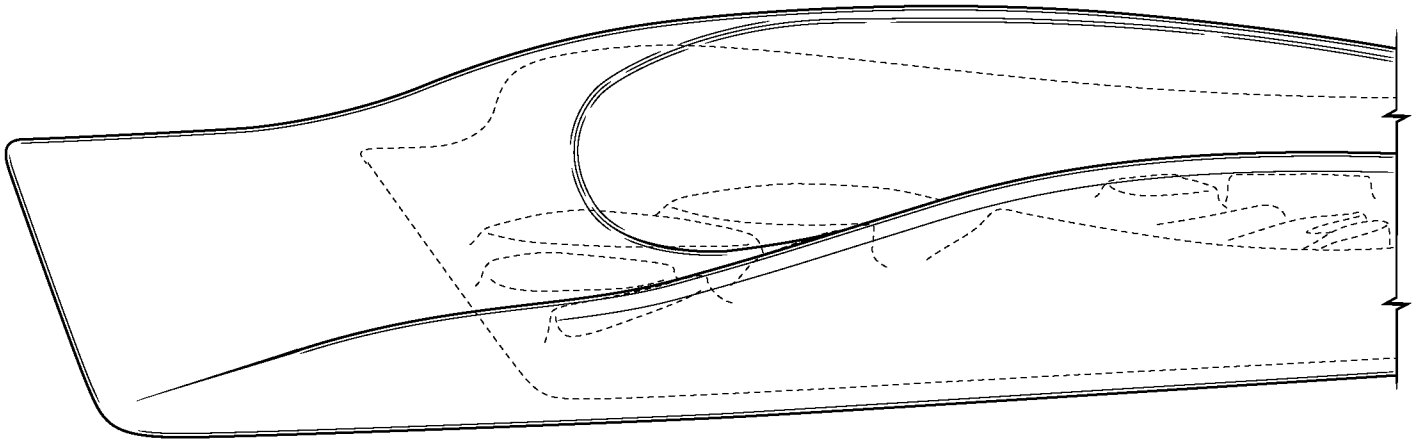
FIG. 8D is a lateral side view of the overlaying layer and the mold layer of an exemplary patient arm support.
Figure 9A:
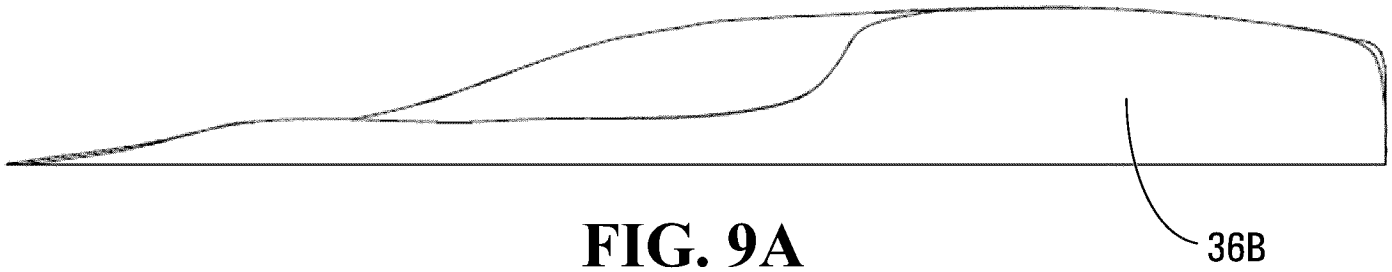
FIG. 9A is a drawing of a first side view of an exemplary patient arm support.
Figure 9B:
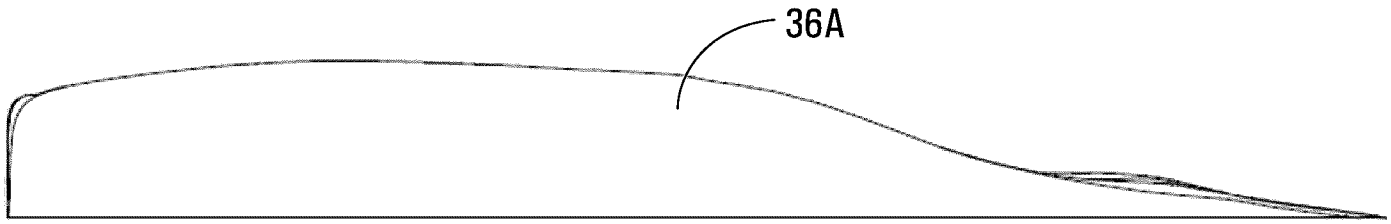
FIG. 9B is a drawing of a second side view of an exemplary patient arm support.
Figure 9D:
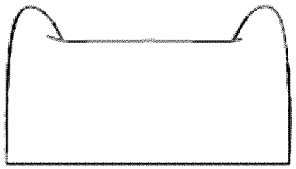
FIG. 9D is a drawing of a back view of an exemplary patient arm support.
Figure 9C:
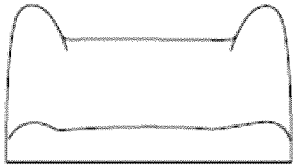
FIG. 9C is a drawing of a front view of an exemplary patient arm support.
Figure 9E:
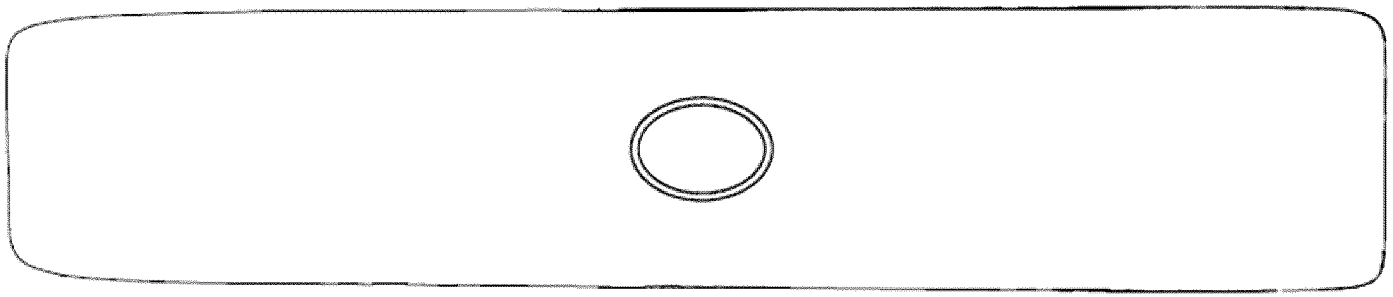
FIG. 9E is a drawing of a top view of an exemplary patient arm support.
Figure 9F:
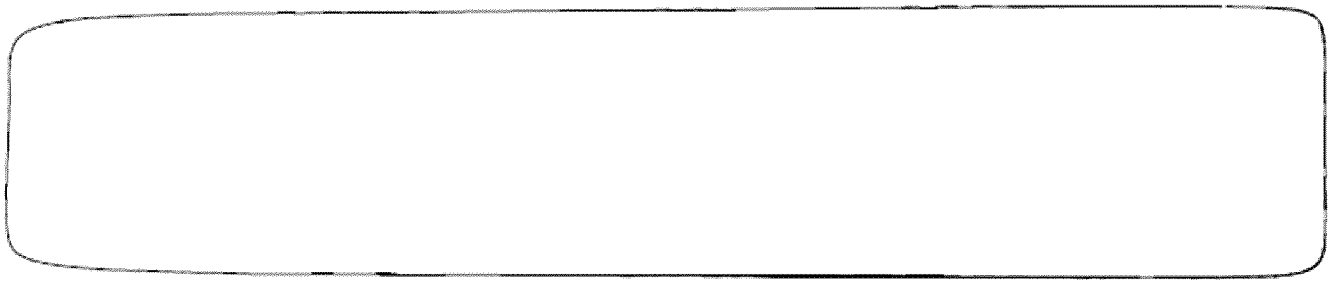
FIG. 9F is a drawing of a bottom view of an exemplary patient arm support.

FIG. 6 shows an exemplary method 50 for positioning a patient's arm on a patient arm support 30 during a surgical operation. First, the patient arm support 30 is positioned on the operating table at step 51. When two of the patient arm supports 30 are used, the distance between both patient arm supports 30 should be such that the tapered portion 32 of each of the patient arm supports 30 may accommodate the shoulder complex 11 of a patient lying in the supine position. In some embodiments, when two patient arm supports 30 are placed one facing the other in order to receive each of the patient's arms, each of the tapered portions 32 of the patient arm supports 30 may be shaped so that one tapered portion 32 may be tucked under the other tapered portion 32 in order to adjust the patient arm support 30 to the length of the patient's arm(s). The patient arm support 30 is positioned on the operating table so as to receive the arm of the patient resting in a supine position. The patient arm support 30 may thus be placed on the lateral portion 22 of the operating table.

Optionally, the patient arm support 30 may be secured in place onto the operating table 20 using a fastening means as described herein.

The patient is laid down onto the operating table 20 in the supine position and the shoulder complex 11 of the patient is positioned over the tapered portion 32 of the patient arm support 30 at step 52. The weight of the patient, exerted on the tapered portion 32 of the patient arm support 30 and wedging the tapered portion 32 against the operating table 20, may secure the patient arm support 30 in place.

The patient's arm, or at least a portion of the patient's arm, is then placed in the groove 37 of the patient arm support 30 at step 53. Optionally, size adjustments of the patient arm support 30 may be made in order to accommodate different arm lengths and proportions.

The arm is positioned in such a manner so as to not over-extend or cause undue extension or flexion at the level of the joints, in a supine position. When placing the arm in the patient arm support 30, the patient arm support 30 is adjusted so that the elbow is positioned in the elbow region 31 of the groove 37 at step 54A. This positioning may reduce pressure exerted by the surface of the patient arm support 30 on the elbow and the ulnar nerve during the operation. Optionally, when the patient arm support 30 has an elbow marking 44 on its exterior marking the location of the elbow region 31 in the groove 37, the elbow marking 44 is aligned with the patient's elbow so that the elbow is positioned in the elbow region 31 at step 54B.

The patient's hand 14 may then be placed on the hand portion 33 of the patient arm support 30, where the palms may be facing up, at step 55A. The hand support 33 may accommodate the entire hand 14 of the patient. An upward curved portion 43 of the hand support 33 may be shaped in order to allow the fingers of the patient's hand 14 to rest in a position where the fingers are curled slightly upward.

Optionally, when the patient arm support 30 has a wrist region 42 and a wrist marking 45 indicating the position of the wrist region 42 in the groove 37, the patient's wrist may be aligned with the wrist marking at step 55B. As such, the patient's wrist is positioned in the wrist region 42.

Optionally, the arm resting in the patient arm support 30 may be massaged using a massaging mechanism, such as an air pump flowing through cavities positioned under the surface on which the arm is resting.

The description of the present invention has been presented for purposes of illustration but is not intended to be exhaustive or limited to the disclosed embodiments. Many modifications and variations will be apparent to those of ordinary skill in the art.

What is claimed is:

1. A method for supporting a patient's arms and for preventing paraesthesia in said arms by using patient arm supports when said patient is anesthetized in a supine position on an operating table comprising:

providing two patient arm supports for positioning on respective arm boards of said operating table, each one of said patient arm supports comprising:

a set of walls defining a groove for receiving an arm, wherein an inside portion of each of the walls forms a curved surface with the groove for receiving the patient's arm;

an upper arm portion having a wedge-shaped tapered portion at one end;

a forearm portion; and an elbow gap located between the upper arm portion and the forearm portion;

placing said patient in said supine position on said operating table with said arms extended over said arm boards;

positioning said two patient arm supports under the arms of the patient with a thinnest portion of the wedge-shaped tapered portion of each one of said two patient arm supports placed between a shoulder complex of the patient, including acromioclavicular, sternoclavicular, glenohumeral and scapulothoracic joints, and the operating table to:

anchor said two patient arm supports to the operating table using a weight of at least a part of the shoulder complex; and use a slope each one of the wedge-shaped tapered portion of said two patient arm supports to provide an upward incline to the shoulder complex to elevate each one of the arms of the patient to reduce strain on a brachial plexus and a shoulder joint of each one of said arms of the patient including muscles, tendons and nerves located in proximity to said shoulder joint; and positioning an elbow of each arm of the patient over the elbow gap to avoid harmful pressure on an ulnar nerve of each arm of the patient.

2. The method of claim 1, further comprising supporting with a hand portion of each of said patient arm supports a respective entire back of a hand joined to said arm.

3. The method of claim 2, further comprising placing fingers of said hand in an upward curved position while said hand is resting on an upward curved portion of said hand portion.

4. The method as defined in claim 1, further comprising positioning each wrist of said patient in a respective wrist region of said patient arm support for-protecting said wrist.

5. The method as defined in claim 1, further comprising massaging said arms by pumping air through air pockets of said patient arm supports using an air pump.

6. The method as defined in claim 1, further comprising fastening each of said patient arm supports to respectively each of said armboards using a fastener.

7. The method as defined in claim 1, wherein each of said wedge-shaped tapered portions is curved.

8. The method as defined in claim 1, wherein said positioning said elbow is performed using an elbow marking located on an outside surface of said patient arm support indicating said elbow gap.

9. A method for supporting a patient's arms and for preventing paraesthesia in said arms by using patient arm supports when said patient is anaesthetized in a supine position on an operating table comprising:

providing two patient arm supports for positioning on respective arm boards of said operating table, each one of said patient arm supports comprising:

a set of walls defining a groove for receiving an arm, wherein an inside portion of each of the walls forms a curved surface with the groove for receiving the patient's arm;

an upper arm portion having a wedge-shaped tapered portion at one end;

a forearm portion; and an elbow gap located between the upper arm portion and the forearm portion;

placing said patient on said operating table in the supine position with arms extending over said arm boards;

positioning said two patient arm supports under the arms of the patient with a thinnest portion of the wedge-shaped tapered portion of each one of said two patient arm supports placed between a shoulder complex of the patient, including acromioclavicular, sternoclavicular, glenohumeral and scapulothoracic joints, and the operating table to:

anchor said two patient arm supports to the operating table using a weight of at least a part of the shoulder complex;

use a slope of each one of the wedge-shaped tapered portions of said two patient arm supports to provide an upward incline to the shoulder complex to elevate each one of the arms of the patient to reduce strain on a brachial plexus and a shoulder joint of each one of said arms of the patient including muscles, tendons and nerves located in proximity to said shoulder joint; and cup the shoulder complex using a curved upper surface of the tapered portion on which rests the shoulder complex; and positioning an elbow of each arm of the patient over the elbow gap to avoid harmful pressure on an ulnar nerve of each arm of the patient.

* * * * *